United States Patent [19]

Berger et al.

[11] Patent Number: 4,767,691

[45] Date of Patent: Aug. 30, 1988

[54] PHOTOGRAPHIC FILM ASSEMBLAGE

[75] Inventors: Michael Berger, Chestnut Hill; Robert Cavallaro, Norwood, both of Mass.; Frank M. Czumak, Salem, N.H.

[73] Assignee: Polaroid Corporation, Cambridge, Mass.

[21] Appl. No.: 45,445

[22] Filed: May 4, 1987

[51] Int. Cl.[4] ..... G03C 5/54; G03C 3/00; G03D 5/02

[52] U.S. Cl. ..... 430/210; 430/207; 430/499; 354/304

[58] Field of Search ..... 430/207, 210, 499; 354/304

[56] References Cited

U.S. PATENT DOCUMENTS

| | | | |
|---|---|---|---|
| 3,682,637 | 8/1972 | Land | 430/210 |
| 3,756,824 | 9/1973 | Chen | 430/499 |
| 4,199,240 | 4/1980 | Norris | 354/86 |
| 4,279,988 | 7/1981 | Ewald | 430/210 |
| 4,289,840 | 9/1981 | Sylvester | 430/210 |
| 4,294,906 | 10/1981 | Bechle et al. | 430/210 |

*Primary Examiner*—Richard L. Schilling
*Attorney, Agent, or Firm*—Alfred E. Corrigan

[57] ABSTRACT

A photographic film assemblage includes a pair of sheets bonded together around their edges and being in liquid communication with a sealed rupturable container of film processing liquid. An aperture in one of the sheets is covered by a film chip which, subsequent to exposure, is exposed to the processing liquid through the aperture after the container is ruptured. An image-receiving portion of the film chip is manually separable from the assemblage after suitable developing has occurred. Preferably, the image-receiving portion is a positive color transparency of a 35 MM size ready for immediate placement in a film mount for subsequent use in a viewer or projector.

11 Claims, 2 Drawing Sheets

PHOTOGRAPHIC FILM ASSEMBLAGE

FIELD OF THE INVENTION

This invention relates to a photographic film assemblage of the instant or self-developing type.

BACKGROUND OF THE INVENTION

Cameras and film for instant developing are well known in the industry and an example of the same may be seen in the Land U.S. Pat. No. 3,682,637. It describes a film assemblage to be mounted in a camera where the film is exposed and subsequently pulled through a pair of rollers. The rollers rupture a container of film processing liquid which is a part of the assemblage and spread the liquid uniformly over the exposed film.

Particular attention is called to FIG. 5 of the '637 patent which shows a plurality of layers of very small thickness which comprise a part of the assemblage. The assemblage includes a sheet which may be employed intact as a transparency subsequent to its separation from the remainder of the film assemblage; or, in a preferred embodiment, the sheet may be constructed from several layers including an image-receiving layer which may be stripped from a photosensitive layer subsequent to the formation of a visible image in the image-receiving layer so as to produce a positive color transparency of the instant type. However, such transparency is relatively large compared to a 35 MM transparency and thus does not readily lend itself for mounting in a frame for use with a projector or viewer specifically contructed for use with the 35 MM format. Further, such a film assemblage is relatively "dirty" in that the photographer is left with a sheet of material containing chemicals left over from the processing operation after the stripping of the image-receiving layer.

A more recent patent in the instant film processing industry is U.S. Pat. No. 4,199,240 to Norris and it is representative of current technology which combines a photographic film assemblage for exposure which is subsequently inserted into an opaque envelope as the exposed film and assemblage are withdrawn from the camera. The purpose of the opaque envelope is to prevent light exposure until the film processing liquid has accomplished its purpose.

SUMMARY OF THE INVENTION

The invention relates to a photographic film assemblage of the instant or self-developing type having a planar configuration which is substantially identical to that of the more popular sizes of instant type film units commonly used today, e.g., 107 MM by 88 MM or 102 MM by 103 MM, and which is constructed to provide a strippable transparency (negative or positive) having a planar configuration which is compatible with and insertable into film mounts or frames of the 35 MM type.

In a preferred embodiment of the invention, a film assemblage is comprised of first and second sheets secured in superposition with each other by a mask such that they define an open ended envelope. The first sheet is provided with a rectangular aperture, and a rectangular film chip having a planar configuration slightly larger than that of the aperture is secured or bonded to the edges of the aperture. The open end of the aforementioned envelope is coupled to the discharge side of a rupturable container of photographic processing liquid. During the passage of the film assemblage, subsequent to its exposure, between a pair of superposed rollers, the container is ruptured and its contents directed into the envelope and spread in a layer between the first and second sheets. When the processing liquid reaches the aperture in the first sheet, it fills the aperture and coats the bottom or closest layer of the film chip which is a photosensitive layer having an exterior coating of gelatin thereon. After passage of the film assemblage between the rollers, the film assemblage is allowed to remain in a lighttight chamber until the processing liquid has been sufficiently imbibed into the film chip to cause the formation of a visible image within an image-receiving layer of the film chip. When the photosensitive layer of the film chip is no longer susceptible to being further exposed, it, the film assemblage, is moved into the ambient light and, in a preferred embodiment, its image-receiving layer stripped from the remainder of the film chip. The image-receiving layer may now be mounted in a 35 MM frame for subsequent viewing.

During the aforementioned spreading of the processing liquid, the rollers force the film chip toward the second sheet until the edges of the rectangular aperture in the first sheet are sufficiently close to the underlying portions of the second sheet that, upon swelling of the gelatin, by the processing liquid, a bond is formed between such edges and the second sheet, thereby substantially sealing the volume of the aperture in the first sheet from the processing liquid contained in the remainder of the chamber between the first and second sheets. Thus, after the film chip's image-receiving layer has been stripped from the film assemblage, the surface of the latter is relatively dry, except for the centrally located photosensitive sheet, as compared to present peel-apart systems wherein the photosensitive layer of the film assemblage comprises substantially the entire surface area of the film assemblage sans the container of processing liquid.

Objects of the invention not clear from the above summary will become apparent from the detailed description of the preferred embodiments which follows taken in conjunction with the accompanying drawings in which like parts are designated by like reference numerals.

DESCRIPTION OF THE PREFERRED EMBODIMENTS

Figure 1:
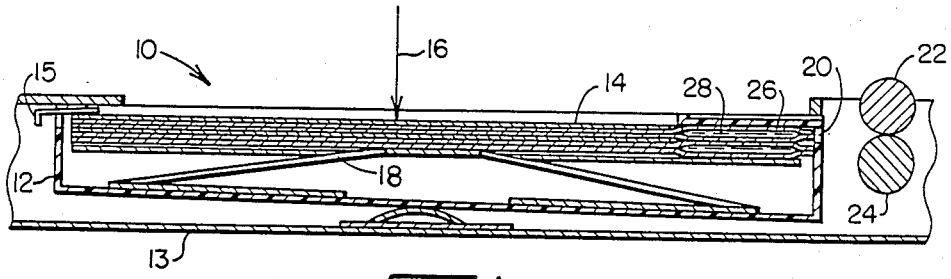
FIG. 1 is a fragmentary sectional view of a film pack mounted in a camera back adjacent a pair of rollers.

Looking to FIG. 1, a film pack 10 includes a housing or cassette 12 designed for mounting in a camera back 13. An uppermost film assemblage 14 in the film pack 10 is designed to receive an exposure, normally an image reflected from a mirror (not shown). The reflection of the image would normally be expected to impinge on the upper assemblage 14 perpendicular to its upper surface along line 16.

The plurality of film assemblages 14 in the housing 12 will be biased upwardly into exposure position by internal spring means 18.

After the exposure of each of the photographic film assemblages 14 in the cassette 12, a reciprocally movable member 15 is actuated so as to move it into engagement with a trailing edge of the uppermost film assemblage 14 and then advance such film assemblage 14 into the bite of a pair of driven rollers 22 and 24 via an opening 20 in a forward wall of the cassette 12. The rollers 22 and 24 continue the advancement of the film assemblage 14 from the cassette 12 while simultaneously rupturing a container 26 of processing liquid 28 located on a leading end of the film assemblage 14 and spreading the liquid 28 between the first and second sheets 30 and 32 so as to intitiate the formation of a visible image within a layer of a film chip secured to an external surface of the first sheet 30, as will be more fully explained hereinafter. It is the intention of this invention that the exposed film assemblage remain in the dark after the container 26 has been ruptured, the processing liquid 28 has been distributed, and until the development process has been substantially completed. Then the assemblage 14 may be moved into the ambient light.

Figure 2:
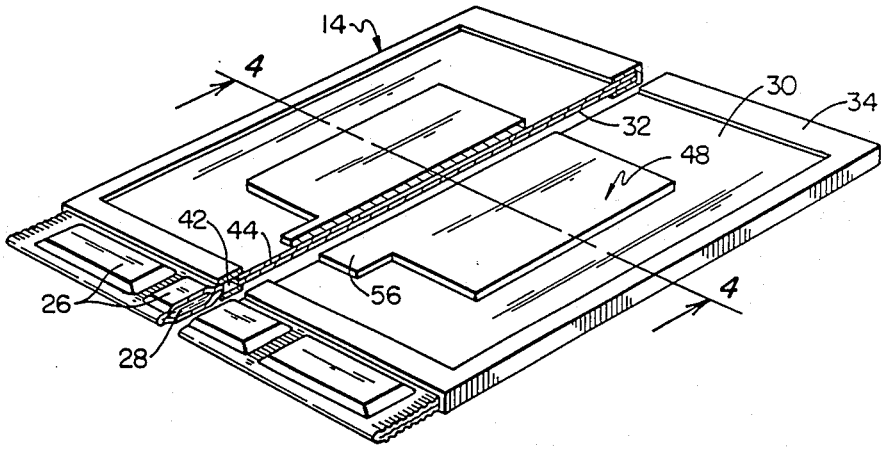
FIG. 2 is a perspective view, partially in section, showing a self-developing, photographic film assemblage embodying the invention.
Figure 4:
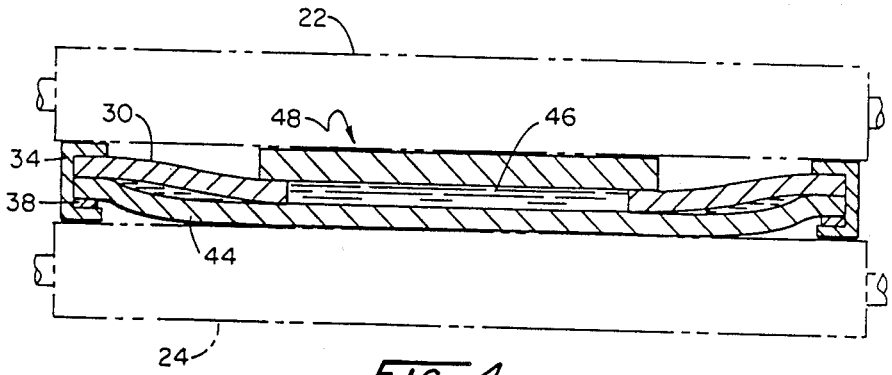
FIG. 4 is a fragmentary sectional view taken along line 4—4 of FIG. 2.
Figure 3:
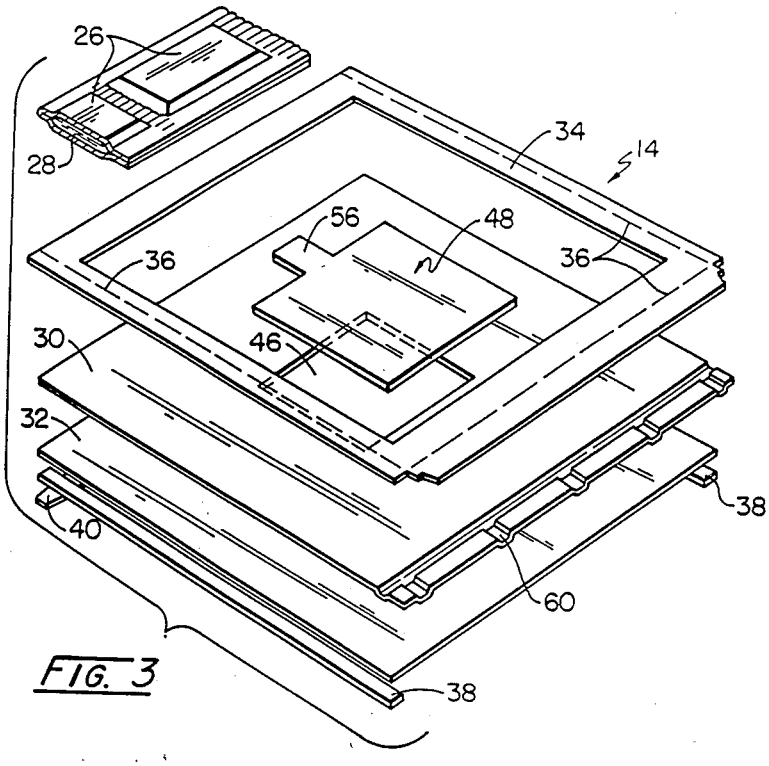
FIG. 3 is an exploded perspective view showing the components of the film assemblage of FIG. 2.

Looking now to FIGS. 2–4, each assemblage 14 will consist of a pair of superposed rectangular sheets 30 and 32 clamped together by the deformation of a mask 34. It should be noted that lower sheet 32 should be opaque to prevent an exposure of the underlying film in the next film assemblage 14 in the housing 12.

The upper sheet 30 and lower sheet 32 are secured together in liquid-tight relationship along three sides by the deformation of the mask 34 along fold lines 36 (best seen in FIG. 3). In the folding or assembling operation, rails 38 mounted below lower sheet 32 are clamped into the assemblage to serve as spacing and strengthening elements. A binding element or strip 40 is located below sheet 32 along the sides of the rectangular sheets which are adjacent the discharge side of the container 26. Element 40 serves to strengthen what is, in effect, the mouth 42 of a chamber or enclosure 44 formed between sheets 30 and 32. Mouth 42 is structured to receive the processing liquid 28 from container 26 when rollers 22 and 24 rupture said container 26 and force the liquid to flow into the cavity 44. An undulating structure 60 shown on the right-hand side of the sheet 30 in FIG. 3 is designed to serve as a trap for excess film processing liquid 28 which has been spread to the end of the cavity 44.

As best seen in FIGS. 3 and 4, an aperture 46 is formed in sheet 30 and a film chip 48 is disposed over the aperture in sealing relationship with the external surface of the sheet 30 most removed from the second sheet to prevent the escape of processing liquid from the envelope formed by sheets 30 and 32. A photosensitive layer 49 and an image-receiving layer 54 are a part of the film chip 48 and the two layers are arranged in proper structural relationship for reacting with the processing liquid after the film chip 48 has been exposed. See FIG. 5 for the structural relationships of the layers of the film chip 48. The film assemblage shown in FIG. 4 is generally designed for use in Polaroid 600 type cameras and measures approximately 107 MM by 88 MM.

Figure 5:
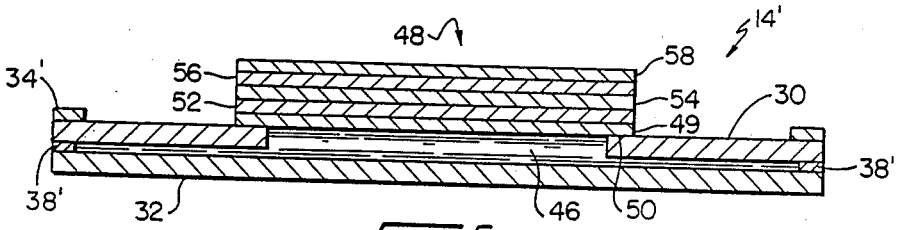
FIG. 5 is a fragmentary sectional view of an alternative film assemblage.
Figure 6:
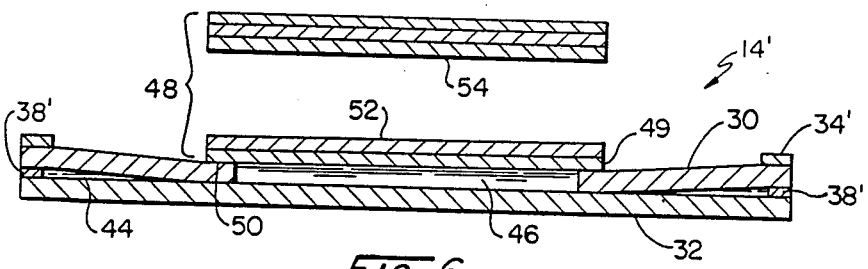
FIG. 6 is a fragmentary sectional view of FIG. 5 with the image-receiving layer separated from the remainder of the film assemblage.

The structure illustrated in FIGS. 5 and 6 represents a film assemblage 14' which is generally of a format similar to the pOlaroid Spectra film which is specifically adapted for use with the new Polaroid Spectra camera.

The film chip 48 illustrated in FIG. 5 is the same film chip as is shown less completely in FIG. 4. Obviously, the vertical dimensional relationships are greatly exaggerated in FIG. 5 for purposes of clarity. The layered film chip has as its lowermost layer a photosensitive or emulsion layer 49 having a coating of gelatin on its lower surface and it is bonded to the external surface of the sheet 30 by a bond 50. The sheet 30 in turn is spaced from the sheet 32 by a pair of longitudinally extending rails 38' located at, and secured to, the lateral margins of the sheets 30 and 32. The rails 38' also function to seal the lateral edges of the film assemblage 14'. A four sided mask 34' extends along the sides of the first sheet 30. The photosensitive layer 49 is in turn bonded by an adhesive layer 52 to an image-receiving layer 54. A tab 56 (see FIG. 3) is attached to image-receiving layer 54 and extends therefrom for purposes which will be explained subsequently. Outwardly from the image-receiving layer 54 is an additive color screen 56 followed by a transparent layer 58 which is primarily for protection against dust and the like and may be made of MYLAR.

The sheet 30 is preferably formed from polyester in that the polyester bonds conveniently to the photosensitive layer 49 of the film chip by a bond which serves the desirable structural needs, namely, the bond 50 between the photosensitive layer 49 and the polyester layer 30 must be stronger than the bond by the adhesive layer 52 between the photosensitive layer 49 and the image-receiving layer 54 because it is an intent of a preferred embcdiment of this invention to have the image-receiving layer 54 stripped from the remainder of the film assemblage by manual manipulation of the tab 56. Specifically, the tab 56 may be grasped between thumb and forefinger and when the bond layer 52 is placed in tension, it will separate because it is a weaker bond than the bond 50 between polyester layer 30 and photosensitive layer 49. Alternatively, the tab 56 may be omitted and the user's finger nail used to strip the image-receiving layer.

In operation the film cassette 12 is loaded into the camera back 13 and a shutter is actuated so as to expose the uppermost film assemblage 14 or 14' in the cassette 12. The exposed film assemblage is then advanced through the exit slot 20 into the bite of rollers 22,24. Continued advancement of the film assemblage causes rupture of the pod 26 of processing liquid 28 and the rollers will squeeze the liquid through the opening or mouth 42 leading to cavity 44 formed between sheets 30,32.

As the rollers advance past the mouth 42 their spacing is controlled, in part, by the vertical height of the two layers 30, 32, the mask 34 and the rail 38 (as seen in FIG. 4) and later by the combined height of the two layers 30, 32 and the film chip 48. The processing liquid 28 is eventually urged into and fills the aperture 46 so as to impregnate the photosensitive layer 49 and initiate the formation of a visible image within image-receiving layer 54. Excess liquid 28 is urged by the advancing rollers 22 and 24 toward the excess liquid repository at 60.

The film assemblage is advanced past the rollers into a single dark chamber (not shown) which may be part of the camera. After a suitable period of time, the assemblage is withdrawn from the dark chamber and the tab 56 is manually manipulated so as to strip the portion of the film chip 48 containing the visible image from the remainder of the film chip. Specifically, the film chip will separate at layer 52 thus leaving behind any residual processing liquid thereby increasing the visual acuity, stability and brightness of the resultant positive transparency 54.

Although the invention described up to this point relates to a standard size format film assemblage comprising a film chip having a strippable image-receiving layer (35 MM transparency) it should be recognized that the invention applies also to such film assemblages wherein the entire film chip (35 MM format), i.e., the photosensitive and image-receiving layers and ancillary layers, or, a film chip which does not contain an image-receiving layer, is stripped from the first sheet of the film assemblage. In this case, the bond 52 would not be present thereby leaving the bond 50 as the only releasable connection between one or more layers of the film chip and the first sheet 30.

It is contemplated that modifications and charges may be made in the embodiments of the invention as disclosed herein without departing from the inventive concepts manifested by such embodiments. For example, the tab 56 may be attached to the film chip along a weaken line, whereby it may be readily removed therefrom after the image-receiving layer has been stripped from the remainder of the film chip; or it may be severed therefrom by a pair of scissors. Accordingly, it is expressly intended that the foregoing description be considered illustrative of preferred embodiments only, not limiting, and that the true spirit and scope of the present invention be determined only be reference to the appended claims.

What is claim is:

1. A photographic film assemblage of the self-developing type comprising: first and second superposed sheets secured to each other along peripheral margins so as to define a chamber having an open end, said first sheet including means defining an aperture therein; a rupturable container of processing liquid mounted adjacent one end of said first and second sheets, said container having means defining a discharge side located in communication with said open end of said chamber; a film chip having an area slightly larger than said aperture and substantially smaller than the area of said first sheet, said film chip being located in superposed alignment with said aperture on a surface of said first sheet most remote from said second sheet, said film chip comprising a plurality of superposed layers including at least a photosensitive layer and an image-receiving layer; and means for releasably securing said image-receiving layer to said first sheet, whereby, subsequent to the photographic exposure of said photosensitive layer, and the rupturing of said container and the spreading of its contents between said first and second sheets and between said film chip and said second sheet to initiate the formation of a visible image in said image-receiving layer, said image-receiving layer may be stripped from said first sheet.

2. A photographic film assemblage as defined in claim 1 wherein said means for releasably securing said image-receiving layer to said first sheet includes a first bond located between said image-receiving layer and said photosensitive layer and a second bond located between said photosensitive layer and said first sheet, said first bond being weaker than said second bond.

3. A photographic film assemblage as defined in claim 1 wherein peripheral edges of said aperture in said first sheet are pressed sufficiently close to underlying portions of said second sheet so as to define a seal therebetween during the passage of said film assemblage between a pair of rollers and the resultant spreading of the processing liquid between said first and second sheets.

4. A photographic film assemblage as defined in claim 1 wherein said film chip further includes a tab for facilitating the stripping of said image-receiving layer from said first sheet.

5. A photographic film assemblage as defined in claim 4 wherein said tab is integrally formed with said image-receiving layer.

6. A photographic film assemblage of the self-developing type comprising: first and second superposed sheets secured to each other along peripheral margins so as to define a chamber having an open end, said first sheet including means defining an aperture therein; a rupturable container of processing liquid mounted adjacent one end of said first and second sheets, said container having means defining a discharge side located in communication with said open end of said chamber; a film chip having an area slightly larger than said aperture and substantially smaller than the area of said first sheet located in superposed alignment with said aperture on a surface of said first sheet away from said second sheet, said film chip comprising a plurality of superposed layers including at least a photosensitive layer; and means for releasable securing at least a portion of said film chip to said surface of said first sheet, whereby subsequent to the photographic exposure of said photosensitive layer, and the rupturing of said container and the spreading of its contents between said first and second sheets and between said film chip and said second sheet to initiate the formation of a visible image in said portion of said film chip, said portion may be stripped from said first sheet.

7. A photographic film assemblage as defined in claim 6 wherein said portion of said film chip includes an image-receiving layer.

8. A photographic film assemblage of the self-developing type comprising:

first and second superposed rectangular sheets of material joined on three sides of their peripheries to form an open ended enclosure;

a rupturable container of photographic processing liquid coupled in closing relation to said open end of said enclosure such that its contents will be directed into said enclosure upon rupture of said container;

means defining an aperture in a surface of said first sheet; and a film chip superposed over said aperture and bonded to an external surface of said first sheet most removed from said second sheet, said film chip includes a plurality of layers including a photosensitive layer being bonded to said external surface of said first sheet by a bond of one strength and to an image-receiving layer by a bond of a lesser strength, whereby after (1) the photographic exposure of said photosensitive layer, (2) the spreading of the processing liquid in a layer between said second sheet and said film chip, and (3) the formation of a visible image in said image-receiving layer, said image-receiving layer may be stripped from the portion of said film chip containing said photosensitive layer.

9. A photographic film assemblage as defined in claim 8 wherein peripheral edges of said aperture in said first sheet are pressed sufficiently close to underlying portions of said second sheet so as to define a seal therebetween during the passage of said film assemblage between a pair of rollers and the resultant spreading of the processing liquid between said first and second sheets.

10. A photographic film assemblage as defined in claim 8 wherein said film chip has a planar configuration substantially equal to that of a 35 MM film frame.

11. A photographic film assemblage as defined in claim 8 wherein said film chip further includes a tab for facilitating the manual stripping of said image-receiving layer.

* * * * *